US006854817B1

(12) United States Patent
Simon

(10) Patent No.: US 6,854,817 B1
(45) Date of Patent: Feb. 15, 2005

(54) UNDERMOUNT DRAWER SLIDE

(75) Inventor: Trevor Simon, Lake Forest, CA (US)

(73) Assignee: Accuride International Inc., Santa Fe Springs, CA (US)

( * ) Notice: Subject to any disclaimer, the term of this patent is extended or adjusted under 35 U.S.C. 154(b) by 0 days.

(21) Appl. No.: 10/888,108

(22) Filed: Jul. 9, 2004

Related U.S. Application Data

(63) Continuation of application No. 10/453,881, filed on Jun. 2, 2003, now abandoned.

(51) Int. Cl.[7] ..... A47B 88/00
(52) U.S. Cl. ..... 312/334.6; 312/334.9
(58) Field of Search ..... 312/334.6, 334.7, 312/334.9, 334.11, 334.12, 334.13, 334.14, 334.15, 334.16, 334.17, 334.18, 334.33, 334.37, 334.38, 334.39; 384/18, 19, 23

(56) References Cited

U.S. PATENT DOCUMENTS

| | | | | | |
|---|---|---|---|---|---|
| 1,112,900 | A | | 10/1914 | Etheridge | |
| 2,055,714 | A | | 9/1936 | Baker | |
| 2,708,767 | A | | 5/1955 | Dean | |
| 3,221,691 | A | | 12/1965 | Laxo | |
| 3,245,512 | A | | 4/1966 | Heyer | |
| 3,275,391 | A | | 9/1966 | Blais | |
| 3,591,906 | A | | 7/1971 | Leiber | |
| 3,650,577 | A | * | 3/1972 | Gutner | 384/21 |
| 3,778,121 | A | | 12/1973 | Levesque | |
| 3,790,233 | A | | 2/1974 | Polidor | |
| 3,897,119 | A | | 7/1975 | McMurtrie | |
| 3,960,413 | A | | 6/1976 | Abbuhl et al. | |
| 4,199,200 | A | * | 4/1980 | Livingston | 384/19 |
| 4,215,904 | A | | 8/1980 | Teramachi | |
| 4,465,324 | A | * | 8/1984 | Rock et al. | 384/19 |
| 4,479,683 | A | | 10/1984 | Kanamaru | |
| 4,598,957 | A | | 7/1986 | Shibayama | |
| 4,697,934 | A | | 10/1987 | Hölzle | |
| 4,746,232 | A | | 5/1988 | Gugel | |
| 4,752,143 | A | | 6/1988 | Lautenschläger, Jr. | |
| 4,779,999 | A | * | 10/1988 | Lautenschlager | 384/18 |
| 4,799,802 | A | | 1/1989 | Lautenschlager | |
| 4,955,160 | A | * | 9/1990 | Rock | 312/334.8 |
| 4,974,972 | A | | 12/1990 | Boosler, Jr. et al. | |
| 5,022,768 | A | | 6/1991 | Baxter | |
| 5,314,253 | A | | 5/1994 | Grass, Jr. | |
| 5,423,615 | A | | 6/1995 | Hara et al. | |
| 5,441,350 | A | | 8/1995 | Fujita | |
| 5,718,515 | A | | 2/1998 | Furuhashi | |
| 5,769,518 | A | * | 6/1998 | Grabher | 312/334.6 |
| 5,775,788 | A | * | 7/1998 | Sasse et al. | 312/334.38 |
| 5,961,221 | A | | 10/1999 | Kamimura | |
| 6,347,849 | B1 | | 2/2002 | Müterthies et al. | |
| 6,428,128 | B1 | * | 8/2002 | Henriott et al. | 312/334.12 |
| 6,481,812 | B1 | * | 11/2002 | Domenig et al. | 312/334.6 |
| 6,682,160 | B2 | * | 1/2004 | Kung | 312/334.6 |

FOREIGN PATENT DOCUMENTS

| | | |
|---|---|---|
| DE | 2721231 | * 11/1978 |
| EP | 1022477 | * 7/2000 |
| JP | 57167515 | 10/1982 |
| JP | 61291308 | 12/1986 |

* cited by examiner

*Primary Examiner*—Janet M. Wilkens
(74) *Attorney, Agent, or Firm*—Christie, Parker & Hale, LLP

(57) ABSTRACT

An undermount drawer slide with an intermediate rail with abutments and vertically aligned roller bearings. An offset flange of a cabinet rail extends into a mouth of the intermediate rail. A C-shaped shelf rail wraps around the angled abutments of the intermediate rail.

18 Claims, 7 Drawing Sheets

UNDERMOUNT DRAWER SLIDE

CROSS-REFERENCE TO RELATED APPLICATION

The present application is a continuation of U.S. patent application Ser. No. 10/453,881, filed Jun. 2, 2003, now abandoned and entitled UNDERMOUNT DRAWER SLIDE, the disclosure of which is hereby incorporated by reference as if set forth in full herein.

BACKGROUND OF THE INVENTION

The present invention relates generally to drawer slides, and more specifically to undermount drawer slides.

Drawer slides are ubiquitous in cabinets, cabinet type structures, and rack mounted applications. Drawer slides are often used to extensibly attach drawers and the like to cabinets, with extension of the drawer from the cabinet allowing for easy access to the contents of the drawers. In general, drawer slides are useful in providing extensible attachment of items to structures.

There are a number of types of drawer slides. The types of drawer slides include telescopic drawers slides, in which the rails making up the drawer slide are nested within one another and extend in a telescopic manner, over and under drawer slides, in which one rail is positioned over another rail, and side by side drawer slides, in which the rails are placed next to each other.

Another type of drawer slide is an undermount drawer slide. Undermount drawer slides are adapted to be placed under a drawer or the like. This is unlike the general use of other types of slides, which are often mounted to the sides of a drawer or item. Placement under a drawer or item may be convenient in that in use the slides generally remain hidden underneath the drawer when extended. Being placed directly under a drawer or other extensibly mounted item, however, raises design issues. The load bearing characteristics are different than, for example, a telescopic drawer slide mounted on the sides of a drawer, particularly when a heavy drawer is extended.

In addition, in many applications the cabinet or other supporting structure is not adapted to bear loads on structural elements directly under the drawer. Instead, the cabinet or supporting structure is adapted to bear load along its side walls or a frame attached to, or part of, the side walls. In such circumstances, some means is generally required to extend from the undermount drawer slide underneath the drawer out to the side walls. Such a means allows mounting of the undermount drawer slide to the side of the cabinet. The means, however, further complicates design of the undermount drawer slide, as the means must transfer the load of the drawer to the side wall, which may be some distance from other portions of the undermount drawer slide.

SUMMARY OF THE INVENTION

The present invention provides in some aspects an undermount drawer slide. In one aspect the invention provides an undermount drawer slide comprising a cabinet rail comprising an L-shaped bracket having a first part adapted for mounting to a side wall of cabinet and a second part extending away from the side wall, and an offset flange extending from a longitudinal edge of the second part, the offset flange comprising an offset and a flange; an intermediate rail comprising first and second channel shaped bearing raceways interconnected on one side by a web of the intermediate rail and forming a mouth opposite the rail, the flange of the cabinet rail extending into the mouth, with edges of the second channel raceway including angled abutments extending away from the second channel raceway; first bearings coupling the first channel shaped bearing raceway and the flange; second bearings coupling the second channel shaped bearing raceway and the flange; a shelf rail having a substantially C-shaped cross-section with side bearing raceways interconnected by a web, the web forming a further raceway; third bearings coupling the further raceway and a raceway of the intermediate rail between the angled abutments; fourth bearings coupling each of the side bearing raceways with raceways of the intermediate rail on sides of the angled abutments opposite the angled abutments from the raceway of the intermediate rail between the angled abutments.

In another aspect the invention provides an undermount slide comprising a cabinet rail adapted to be mounted to a cabinet, the cabinet rail having an offset flange; an intermediate rail with a first channel and a second channel interconnected on one side by a web, the intermediate rail having a mouth opposite the web, the mouth receiving a portion of the offset flange of the cabinet rail, the intermediate rail having angled abutments extending away from the second channel; and a shelf rail adapted for supporting a shelf, the shelf rail having a substantially C-shaped cross-section including a web and arcuate raceways, the substantially C-shaped cross-section wrapping around the angled abutments of the intermediate rail.

These and other aspects will be more fully comprehended with review of the figures and discussion herein.

DETAILED DESCRIPTION

Figure 1:
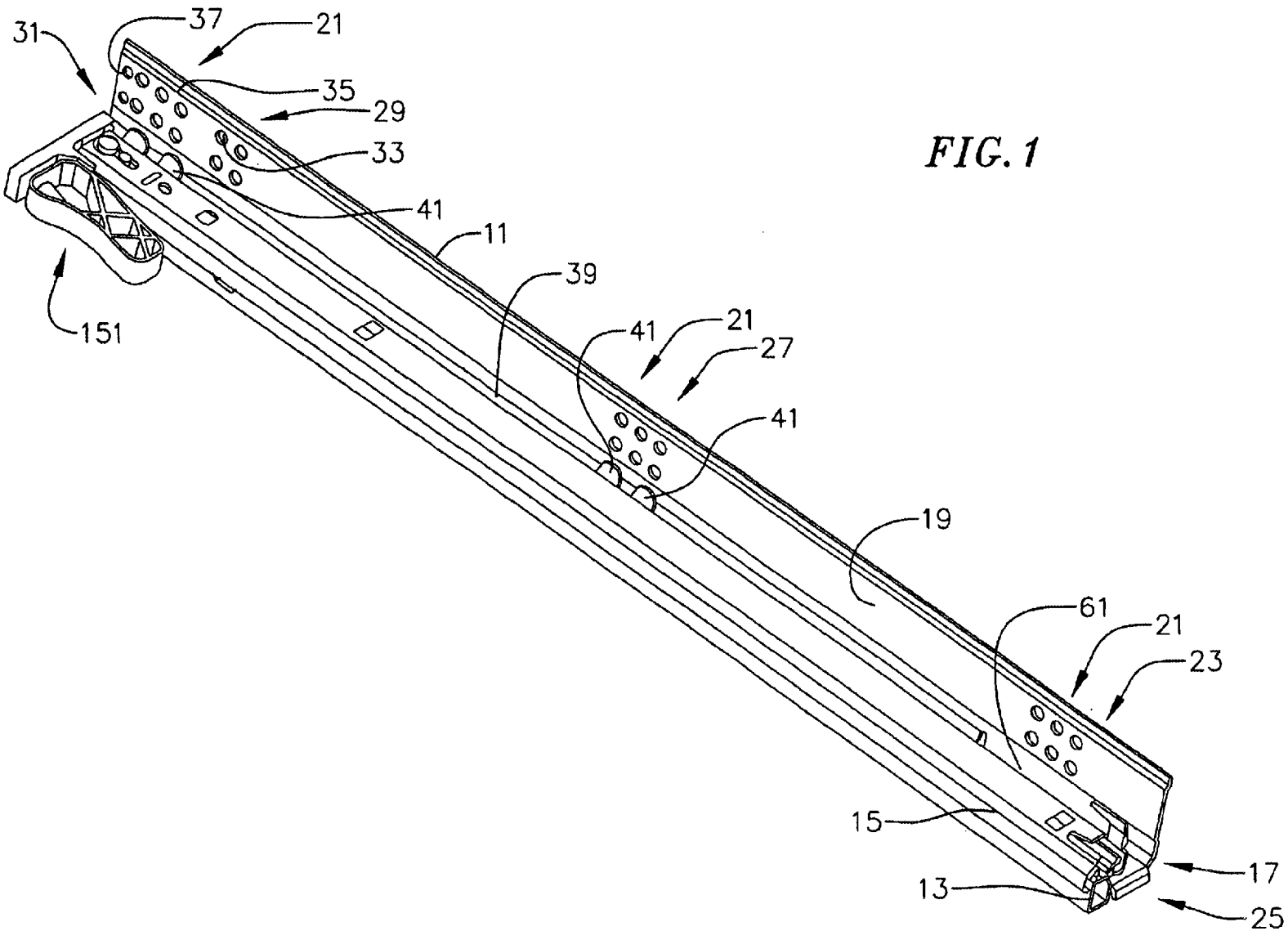
FIG. 1 illustrates a perspective view of an undermount drawer slide in accordance with aspects of the invention.

FIG. 1 illustrates a perspective view of an undermount drawer slide in accordance with aspects of the invention. The undermount drawer slide of FIG. 1 includes three rails. The rails include a cabinet rail 11 adapted for mounting to a side of a cabinet, an intermediate rail 13 coupled to the cabinet rail, and a shelf rail 15 coupled to the intermediate rail. The shelf rail is adapted for connection with a drawer or shelf or the like.

The cabinet rail includes an L-shaped bracket 17 extending away from the intermediate rail, and an offset flange 75 (shown in FIG. 3) extending from an edge of the L-shaped bracket. The offset flange couples the cabinet rail to the intermediate rail, and the L-bracket is used to couple the cabinet rail to a side of a cabinet.

A first part 19 of the L-shaped bracket, distal from the intermediate rail, is used for coupling to a side of the cabinet.

In the embodiment of FIG. 1, the first part of the L-shaped bracket includes patterned mounting holes 21. The patterned mounting holes are convenient in that at times cabinets are configured to receive mounting screws and the like in pre-positioned locations. The pre-positioned locations may vary from cabinet to cabinet and across manufacturers. The patterned mounting holes shown in FIG. 1 provide mounting points corresponding to a great many of the pre-positioned locations used in cabinetry. In particular, the patterned mounting holes of FIG. 1 include a first set of mounting holes 23 approximate a rear 25 of the cabinet rail, a second set of mounting holes 27 approximate the mid-point of the length of the cabinet rail, and a third set of mounting holes 29 approximate a front 31 of the mounting rail. The first set of mounting holes are provided as six holes in two rows and three columns, as are the second set of mounting holes. The third set of mounting holes are provided as a first subset 33 of four holes forming a substantially square outline, a second subset 35 of holes of six holes in two rows and three columns, and a third subset 37 of holes forming a fourth column. The holes of the fourth column are slightly smaller than the other holes in the third set of mounting holes.

In a further embodiment, the first part of the L-shaped bracket includes a recessed portion. Ribs are formed in the recessed portion, with mounting holes providing in the ribs.

A second part 39 of the L-shaped bracket extends towards the intermediate rail. As illustrated in, for example, FIG. 2, the first part and the second part of the L-shaped bracket are of substantially equal width, although this may vary in various embodiments. Generally, the width of the second part of the L-shaped bracket is sufficient to extend from a side of a cabinet to a distance past a sidewall of a drawer adapted to fit within the cabinet. This places a forward edge of the second part of the L-shaped bracket underneath the body of the drawer, approximate locations under the drawer appropriate for mounting of undermount drawer slides.

In some embodiments, and as shown in FIG. 1, gussets 41 are provided along the length of the L-shaped bracket, along the line of connection between the first part of the L-shaped bracket and the second part of the L-shaped bracket. The gussets provide additional structural strength to the L-shaped bracket, allowing for the use of thinner material, thereby reducing material costs.

Figure 2:
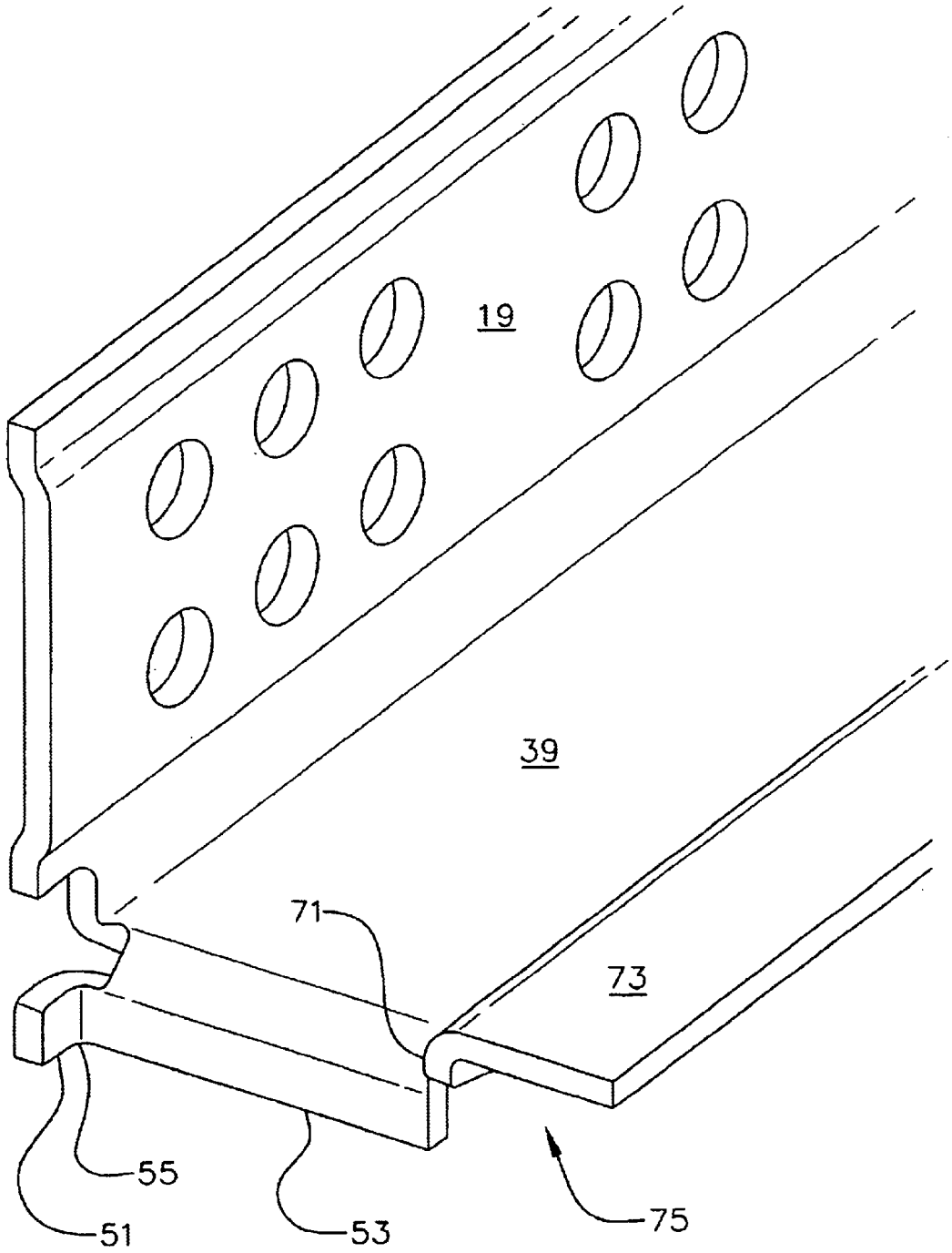
FIG. 2 illustrates a perspective view of a leading edge of an alternative cabinet rail of the undermount drawer slide of FIG. 1.

Also in various embodiments, and as shown in FIG. 2, a stand-off arm 51 is provided at the front of the L-shaped bracket, the front of the L-shaped bracket being towards the front of the cabinet. The stand-off arm, as illustrated in FIG. 2, is formed using a flange 53 on the front of the second part of the L-shaped bracket. The flange extends in what may be viewed as a downward direction from the second part of the L-shaped bracket. An elbow 55 is formed in the flange approximate the first part of the L-shaped bracket, with the arm extending from the elbow. The arm is substantially coplanar with the first part of the L-shaped bracket. The arm, therefore, abuts a portion of the cabinet structure when the first part of the L-shaped bracket is mounted to the cabinet. The abutment of the arm against the cabinet provides for increased support for the slide as a whole, particularly when the slide bears loads.

Figure 5:
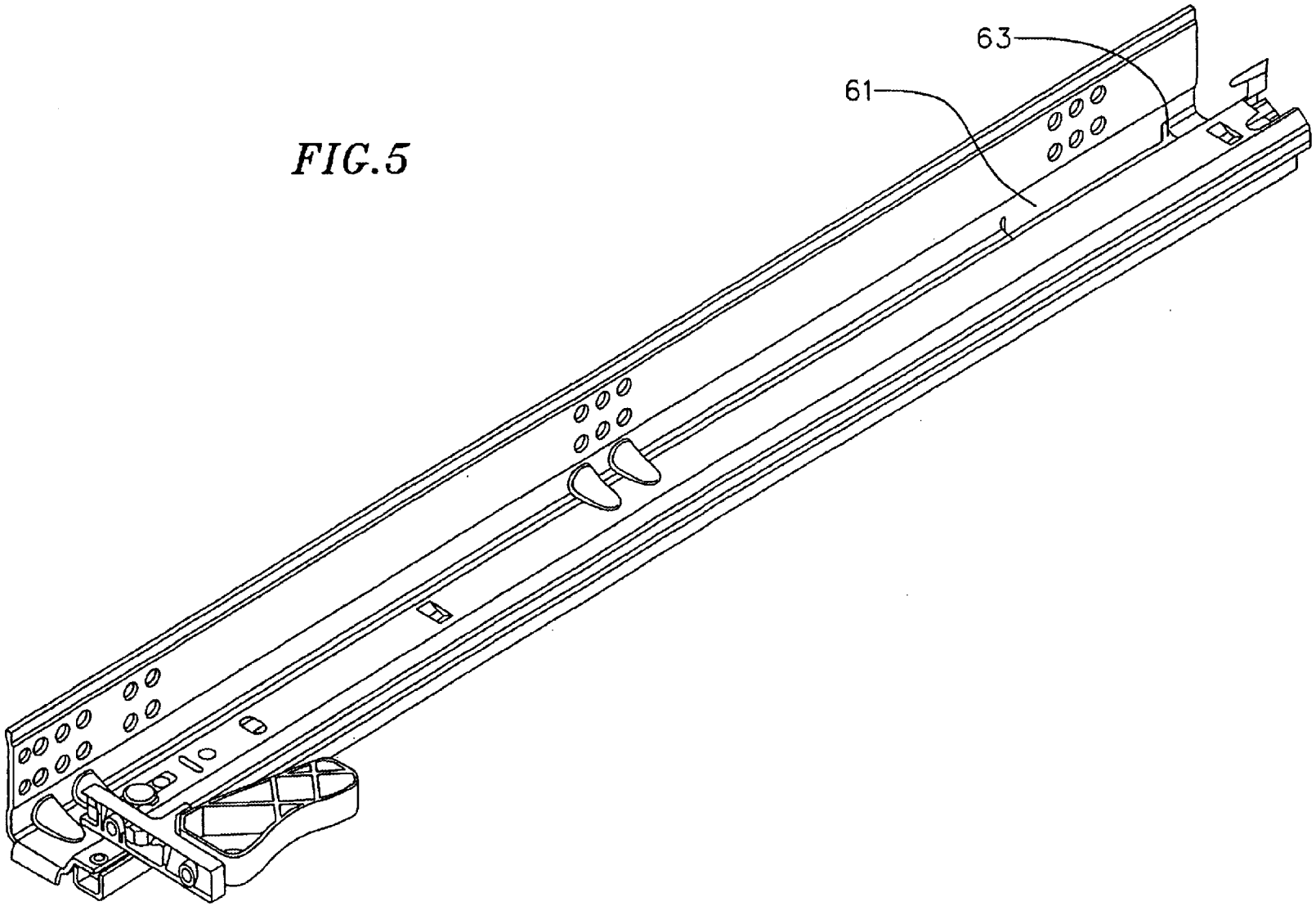
FIG. 5 illustrates a further perspective view of the undermount drawer slide of FIG. 1.

In some embodiments, and as may be seen in FIG. 1 and more fully in FIG. 5, a longitudinal tab 61 is formed to extend from the first part of the L-shaped bracket. The tab is formed by cutting a portion 63 of the second part of the L-shaped bracket approximate the first part of the L-shaped bracket, and bending the portion to extend in a plane defined by the first part of the L-shaped bracket. The tab is useful in providing for coupling of a mounting bracket for the cabinet rail, particularly for face-frame cabinet applications. An embodiment of such a mounting bracket is discussed with respect to FIGS. 6 and 7. In some embodiments the tab may also be useful in providing increased structural resistance in opposing torsional forces applied to the cabinet rail when the undermount drawer slide bears loads.

Figure 3:
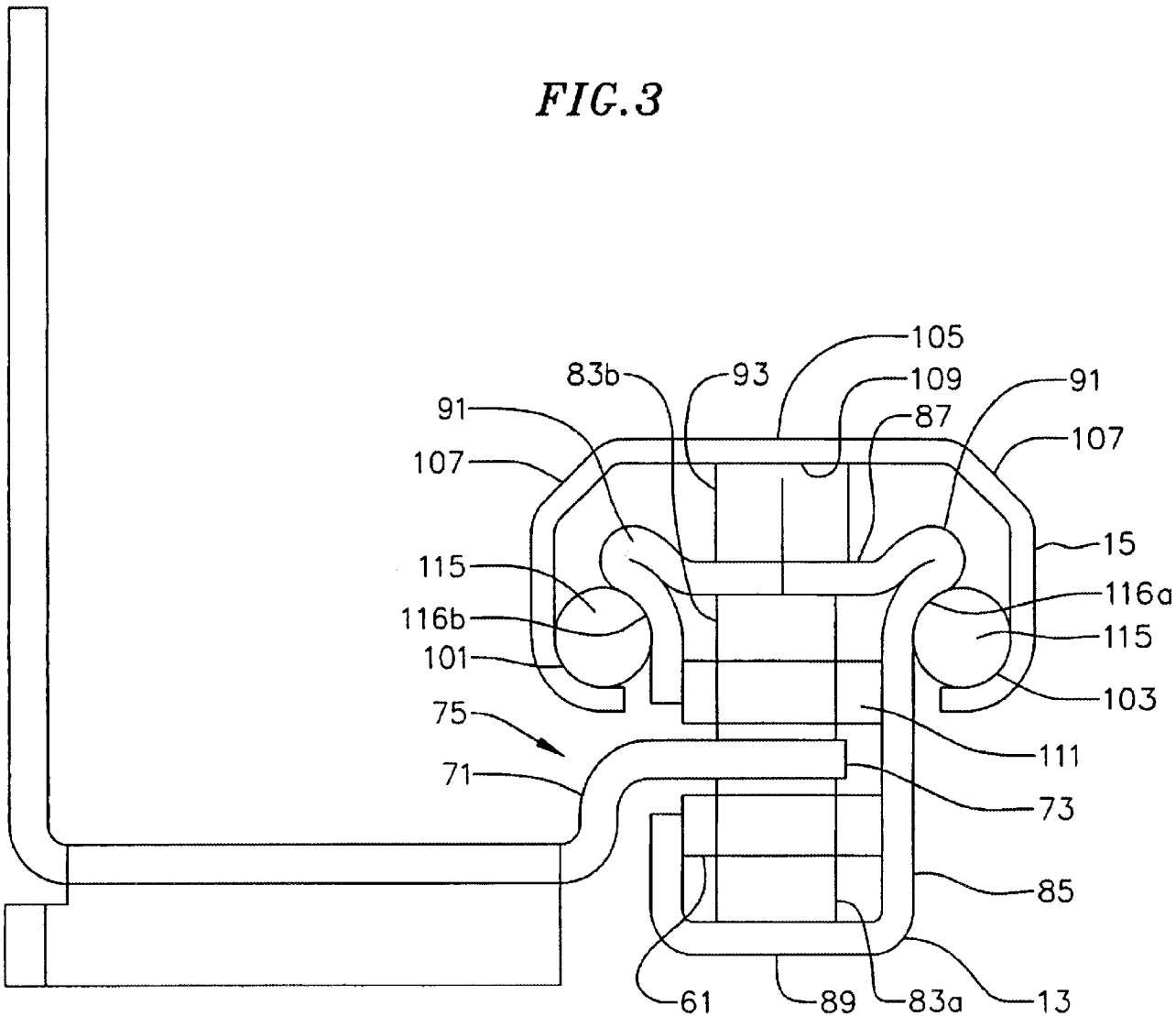
FIG. 3 illustrates a cross-section of an undermount drawer slide including the alternative cabinet rail in accordance with aspects of the invention.

As may be seen in FIGS. 2 and 3, and present in the undermount drawer slide of FIG. 1, along a longitudinal end of the second part of the L-shaped bracket is an angled connector 71, which has a flange 73 along its distal portion. The angled connector and flange, therefore, may together be considered an offset flange 75 from the L-shaped bracket.

Referring to FIG. 3, the intermediate rail 13 is coupled to the flange 73 of the cabinet rail by way of rollers 81 and roller bearings 83*a,b*. The intermediate rail includes a web 85 interconnecting two generally channel-shaped bearing raceways 87,89. The intermediate rail, therefore, is substantially C-shaped, as may be seen in the cross-section of FIG. 3.

The flange 73 is positioned within the mouth of the C-shaped intermediate rail. Roller bearings 83*a,b* interconnect the intermediate rail and the flange, with roller bearing above and below the flange. On the intermediate rail, the roller bearings contact the channel-shaped bearing raceways, which include a substantially flat upper raceway 87 and a substantially flat lower raceway 89.

Along the longitudinal length of the upper raceway are angled abutments 91. The angled abutments provide increased torsional rigidity and strength to the intermediate rail. The angled abutments may also serve to more fully maintain roller bearings 93 interconnecting the intermediate rail and the shelf rail 15, which is positioned about the upper raceway, although in most embodiments position of the roller bearings is maintained using roller cages. In some embodiments, the angled abutments are formed of the intermediate rail, with the angled abutments being formed of folds in the material of the intermediate rail. In some embodiments, and as illustrated in FIG. 3, inner surfaces of the folds are in contact with each other. In some embodiments the angled abutments form an angle of approximately 35 degrees with a plane defined by the substantially flat upper raceway.

The shelf rail, like the intermediate rail, is a C-shaped rail having side bearing raceways 101,103 interconnected by a web 105. The shelf rail in the embodiment of FIGS. 1 and 2, however, does not include angled abutments, instead having somewhat rounded edges 107. The somewhat rounded edges, which form a chamfer, provide clearance for material, such as glue, which may be present on an underside of a drawer or shelf coupled to the shelf rail. The shelf rail extends about the upper raceway of the intermediate rail, encompassing the angled abutments of the intermediate rail. The web of the shelf rail forms a middle bearing raceway 109 which is substantially flat and opposed to the upper raceway of the intermediate rail. The side bearing raceways wrap around the angled abutments of the intermediate rail, and are adapted to receive bearings towards a front edge of the C-shaped shelf rail.

Lower roller bearings 83*a* and upper roller bearings 83*b* couple the flange of the cabinet rail and the lower bearing raceway and the upper bearing raceway, respectively, of the intermediate rail. The lower roller bearings and the upper roller bearings are, as viewed in the partial cross section of FIG. 3, aligned in the vertical direction. This vertical alignment provides good load bearing characteristics.

In addition, rollers 81 are riveted to the flange of the cabinet rail, with the rollers contacting the sides of the channels formed by a lower portion of the intermediate rail. The rollers help counteract torsion forces applied to the undermount drawer slide when loaded. In some embodiments three rollers are used, with at least one of the rollers riveted approximate a front of the flange of the cabinet rail.

Horizontal rollers 111 are also provided in conjunction with the upper roller bearings, the horizontal rollers also coupling the cabinet rail and intermediate rail. In the embodiment of FIG. 3, however, the horizontal rollers are mounted in a bearing cage (not shown) along with the upper roller bearings.

Figure 6:
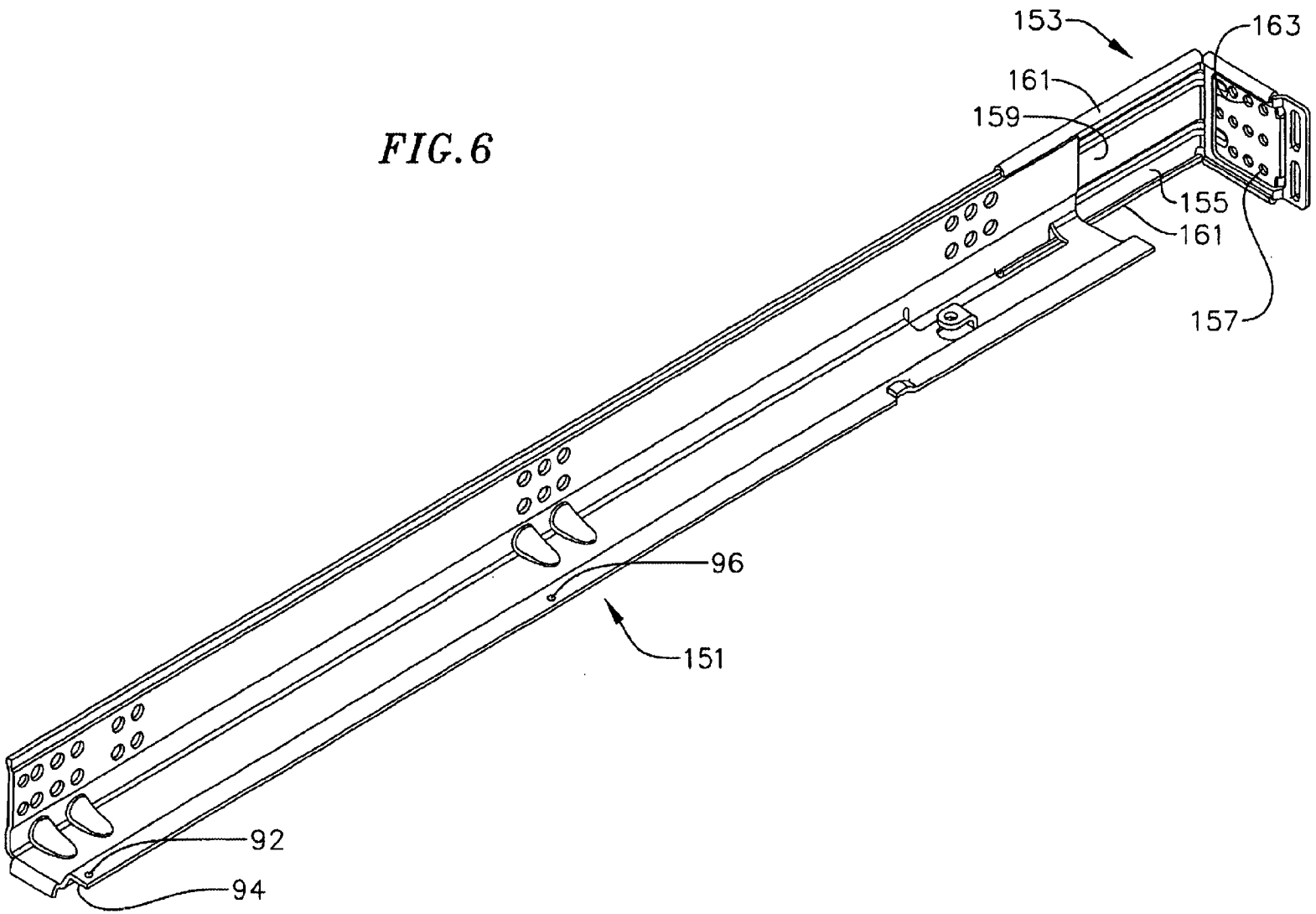
FIG. 6 illustrates a perspective view of a cabinet rail with rear attachment bracket.

In some embodiments rollers are riveted to both upper and lower sides of the flange of the cabinet rail, and the horizontal rollers, being riveted to the flange, are not maintained in bearing cages. In some embodiments a single roller is riveted to the bottom of the flange, and a single roller is riveted to the top of the flange. Referring briefly to FIG. 6, a front rivet hole 92 is formed in the flange approximate a front of the flange 94. A rear rivet hole 96 is formed in the flange slightly forward of a midpoint of the flange. A first roller (not shown in FIG. 6) is riveted to the bottom of the flange using the front rivet hole. A second roller (not shown in FIG. 6) is riveted to the top of the flange using the rear rivet hole. So positioned, the rollers serve as an in-stop and an out-stop for the intermediate rail, interacting, for example, with formed edges approximate a front and rear of an intermediate member. Alternatively, bearings or bearing cages may interact with both the rollers and the formed edges, with the rollers then also serving a bearing recycling function in addition to in-stop and out-stop functions.

Further roller bearings 93 and ball bearings 115 couple the intermediate rail and the shelf rail. The further roller bearings run in the substantially flat raceway on the intermediate rail between the angled abutments, with the further roller bearings contacting the web of the shelf rail. The further roller bearings, therefore, are substantially vertically aligned with the roller bearings coupling the cabinet rail and the intermediate rail. The ball bearings run in the side raceways of the shelf rail and contact sides 116*a,b* of the angled abutments opposite the raceway on the intermediate rail between the angled abutments. The angled abutments, therefore, form raceways to capture the ball bearings.

Figure 4:
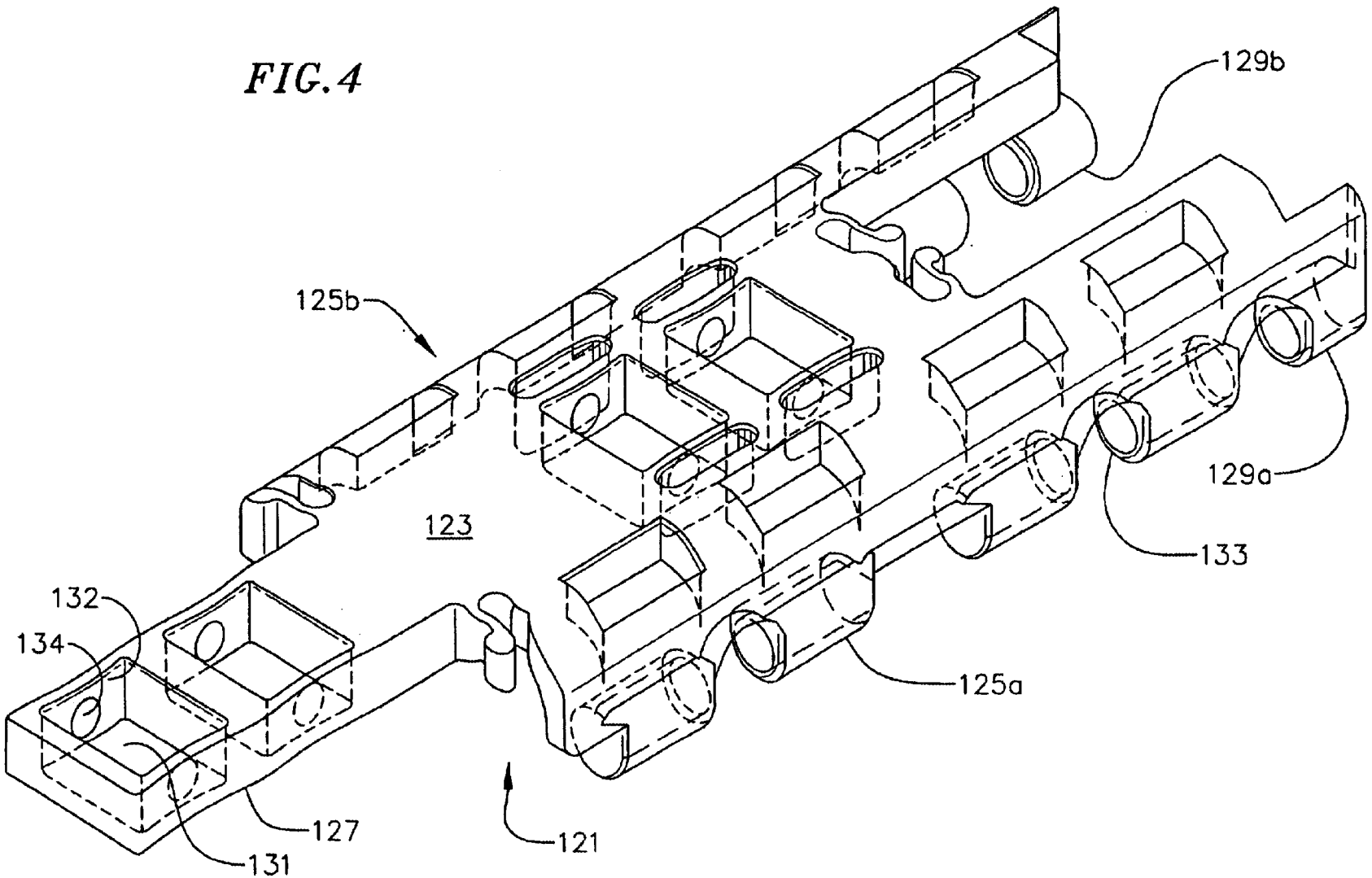
FIG. 4 illustrates a bearing cage useful with undermount drawer slides in accordance with aspects of the invention.

In some embodiments the further roller bearings and the ball bearings are maintained in relative position with respect to one another through the use of a bearing cage 121, as illustrated in FIG. 4. The bearing cage of FIG. 4 is unitarily formed, for example, using a plastic. The bearing cage is somewhat C-shaped, to match the shape of the shelf rail, and includes a body 123 and fins 125*a,b* running along side the body. As illustrated in FIG. 4, the body includes a head 127 extending past the fins, and the fins include tails 129*a,b* extending past the body opposite the head. The body includes a plurality of rectangular apertures 131 adapted to receive roller bearings. The rectangular include chamfers 132 leading to protrusions 134 adapted to extend into a roller hub. The fins include a plurality of recesses 133 adapted to receive ball bearings.

FIG. 6 illustrates a perspective view of a cabinet rail 151, such as the one illustrated in FIG. 1. Coupled to the cabinet rail is a rear mounting bracket 153. The mounting bracket is in substantially the form of an L-bracket, including a coupling portion 155 and a mounting plate 163. The coupling portion includes a substantially planar web 159 with arcuate bent over portions 161 at margins along the web. The bent over portions and the web are dimensioned such that the bent over portions slide over the top of the first part of the L-bracket of the cabinet rail and underneath the longitudinal tab approximate the rear of the cabinet rail. With the coupling portion so coupled to the cabinet rail, the mounting plate extends behind the cabinet rail. The mounting plate includes plurality of mounting holes 157 through which screws or the like may be passed into the cabinet structure. This allows the rear of the cabinet rail to be mounted to the rear of a cabinet. Such mounting is particularly beneficial for use with, for example, face frame cabinets or cabinets generally which do not provide for mounting of slide rails directly to the side wall of the cabinet. Thus, use of the mounting plate and the forward most screw holes on the cabinet rail allow the cabinet rail to be mounted to face frame cabinets.

Figure 7:
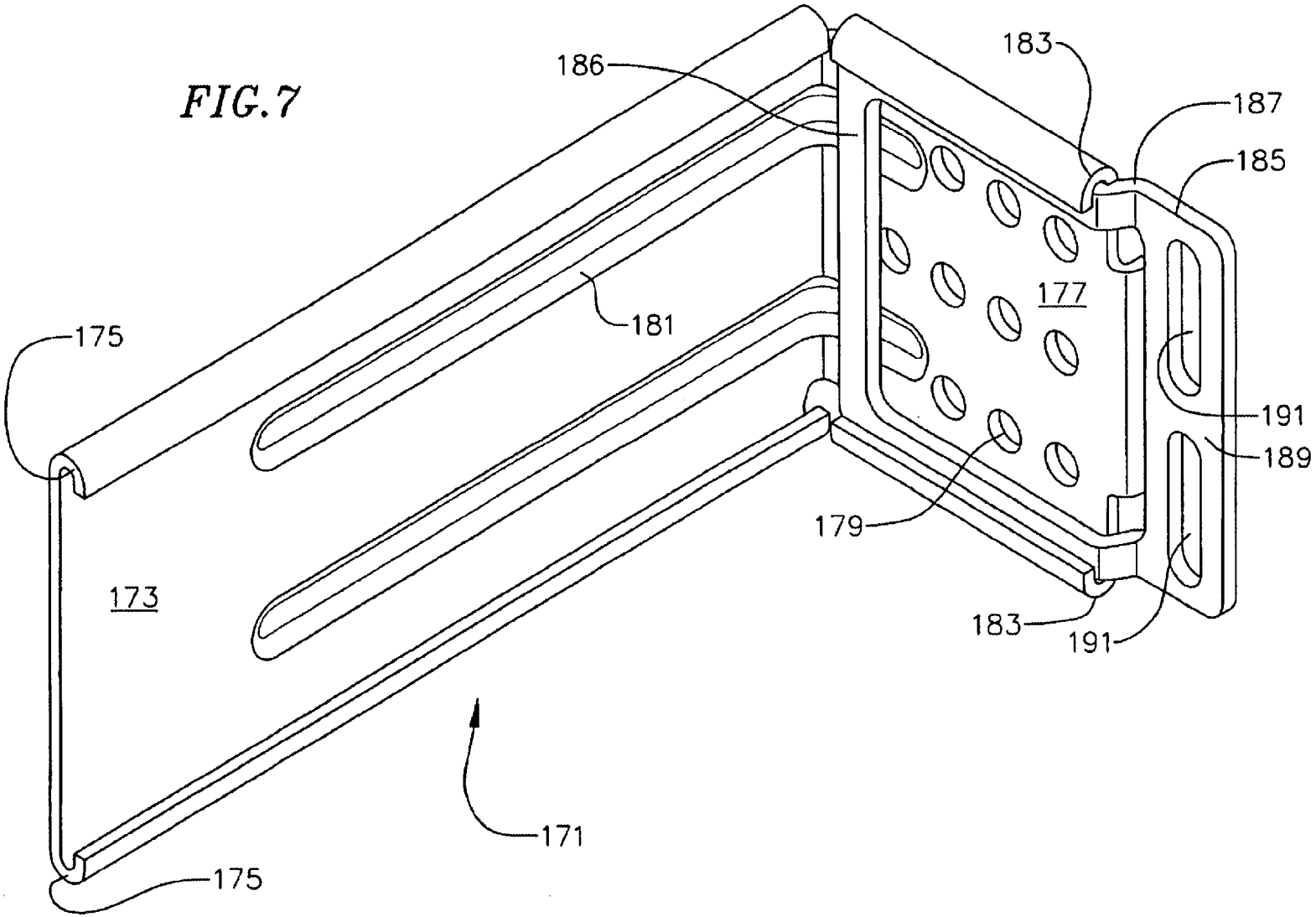
FIG. 7 illustrates a perspective view of the rear attachment bracket of FIG. 6.

FIG. 7 is a perspective view of a mounting bracket such as the one illustrated in FIG. 6. The mounting bracket is substantially an L-bracket. A coupling portion 171 of the mounting bracket includes a substantially planar web 173 and bent over portions 175. The bent over portions are adapted to slide over the top of a cabinet rail and a tab extending below a portion of the cabinet rail, allowing for longitudinal extension and retraction of the mounting bracket to account for varying cabinet depths. A mounting plate 177 forms the other part of the L-bracket of the mounting bracket. The mounting plate includes a plurality of mounting holes 179.

Ribs 181 extend longitudinally across the coupling portion of the mounting bracket and into the mounting plate. The ribs provide further structural strength to the mounting bracket, particularly useful with an extendable bracket. As illustrated in FIG. 7, the mounting plate also includes a bent over portions 183. The bent over portions on the mounting plate are for insertion of an extender 185. The extender includes a face-plate formed of a square frame 186 dimensioned so as to slidably fit within the bent over portions. The square frame includes an open end along the outside of the mounting plate. The open end includes a jog 187 leading to a mounting flange 189. The mounting flange includes apertures 191 which, extending past the mounting plate, extend in an adjustable manner the ability to mount the mounting bracket to portions of the cabinet. In addition, the face plate provides increased structural strength to the mounting plate of the mounting bracket.

Thus, the present invention provides an undermount drawer slide. Although the invention has been described with respect to certain embodiments, it should be recognized that the present invention includes the claims and their equivalents supported by the disclosure.

What is claimed is:

1. An undermount drawer slide comprising:

a cabinet rail comprising an L-shaped bracket having a first part adapted for mounting to a side wall of a cabinet and a second part extending away from the first part, and an offset flange extending from a longitudinal edge of the second part, the offset flange comprising an offset and a flange;

an intermediate rail comprising first and second channel shaped bearing raceways interconnected on one side by a web of the intermediate rail and forming a mouth opposite the web, the flange of the cabinet rail extending into the mouth, with edges of the second channel raceway including angled abutments extending away from the second channel raceway;

first bearings coupling the first channel shaped bearing raceway and the flange;

second bearings coupling the second channel shaped bearing raceway and the flange;

a shelf rail having a substantially C-shaped cross-section with side bearing raceways interconnected by a web, the web forming a further raceway;

third bearings coupling the further raceway and a raceway of the intermediate rail between the angled abutments;

fourth bearings coupling each of the side bearing raceways with raceways of the intermediate rail on sides of the angled abutments opposite the angled abutments from the raceway of the intermediate rail between the angled abutments.

2. The undermount drawer slide of claim 1, wherein the first bearings are roller bearings, the second bearings are roller bearings, the third bearing are roller bearings, and the fourth bearings are ball bearings.

3. The undermount drawer slide of claim 2 wherein the first bearings, the second bearings, and the third bearings are substantially vertically aligned.

4. The undermount drawer slide of claim 1, further comprising a roller affixed to a first side of the flange of the cabinet rail, the roller contacting a side of the first channel shaped bearing raceway of the intermediate rail.

5. The undermount drawer slide of claim 1, wherein at least some of the third bearings and at least some of the fourth bearings are maintained in substantially the same relative position by a bearing cage.

6. The undermount drawer slide of claim 1 further comprising a plurality of gussets interconnecting the first part of the L-shaped bracket of the cabinet rail and the second part of the L-shaped bracket of the cabinet rail.

7. The undermount drawer slide of claim 1 further comprising a support tab located in substantially a plane defined by the first part of the L-shaped bracket of the cabinet rail.

8. The undermount drawer slide of claim 7 wherein the support tab is formed of an arm extending from an elbow of a flange extending from the second part of the L-shaped bracket.

9. The undermount drawer slide of claim 7 wherein the support tab is formed of a tab extending from the first part of the L-shaped bracket past a plane defined by the second part of the L-shaped bracket.

10. The undermount drawer slide of claim 1 wherein the first part of the L-shaped bracket includes patterned mounting holes.

11. The undermount drawer slide of claim 1 wherein the angled abutments are formed of folded over portions of the intermediate rail, the folded over portions having inner surfaces largely in contact with each other.

12. The undermount drawer slide of claim 11 wherein the angled abutments extend at approximately a 35 degree angle from a plane defined by the second raceway of the intermediate rail.

13. An undermount slide comprising:

a cabinet rail adapted to be mounted to a cabinet, the cabinet rail having an offset flange;

an intermediate rail with a first channel and a second channel interconnected on one side by a web, the intermediate rail having a mouth opposite the web, the mouth receiving a portion of the offset flange of the cabinet rail, the intermediate rail having angled abutments extending away from the second channel; and a shelf rail adapted for supporting a shelf, the shelf rail having a substantially C-shaped cross-section including a web and arcuate raceways, the substantially C-shaped cross-section wrapping around the angled abutments of the intermediate rail.

14. The undermount slide of claim 13 further comprising bearings riding in raceways formed by the first channel and the second channel, the bearings contacting the portion of the offset flange received by the mouth of the intermediate rail.

15. The undermount slide of claim 14 further comprising further bearings contacting the intermediate rail and the web of the shelf rail.

16. The undermount slide of claim 15 further comprising bearings riding in raceways formed by the angled abutments and the arcuate raceways of the shelf rail.

17. The undermount slide of claim 16 wherein the cabinet rail further comprises an L-bracket extending from the offset flange away from the intermediate rail.

18. The undermount slide of claim 17 further comprising gussets interconnecting portions of the L-bracket.

* * * * *